US005836389A

United States Patent [19]

Wagner et al.

[11] Patent Number: 5,836,389

[45] Date of Patent: Nov. 17, 1998

[54] APPARATUS AND METHOD FOR INCREASING PRODUCTION RATES OF IMMOVABLE AND UNSWEPT OIL THROUGH THE USE OF WEAK ELASTIC WAVES

[75] Inventors: Dennis Wagner; Reed Juett, both of Arlington Heights, Ill.

[73] Assignee: Wave Energy Resources, Arlington Heights, Ill.

[21] Appl. No.: 762,068

[22] Filed: Dec. 9, 1996

[51] Int. Cl.[6] ..... E21B 43/25

[52] U.S. Cl. ..... 166/249; 166/177.2

[58] Field of Search ..... 166/249, 177.1, 166/177.2

[56] References Cited

U.S. PATENT DOCUMENTS

| | | | |
|---|---|---|---|
| 2,670,801 | 3/1954 | Sherborne | 166/21 |
| 2,799,641 | 7/1957 | Bell | 204/180 |
| 3,016,093 | 1/1962 | Bodine | 166/249 |
| 3,016,095 | 1/1962 | Bodine | 166/177.1 |
| 3,048,226 | 8/1962 | Smith | 166/177.1 |
| 3,141,099 | 7/1964 | Brandon | 310/4 |
| 3,169,577 | 2/1965 | Sarapuu | 166/42 |
| 3,378,075 | 4/1968 | Bodine | 166/45 |
| 3,507,330 | 4/1970 | Gill | 166/248 |
| 3,754,598 | 8/1973 | Holloway, Jr. | 166/249 |
| 3,874,450 | 4/1975 | Kern | 166/248 |
| 3,920,072 | 11/1975 | Kern | 166/248 |
| 3,952,800 | 4/1976 | Bodine | 166/249 |
| 4,049,053 | 9/1977 | Fisher et al. | 166/249 |
| 4,060,128 | 11/1977 | Wallace | 166/249 |
| 4,084,638 | 4/1978 | Whiting | 166/248 |
| 4,345,650 | 8/1982 | Wesley | 166/249 |
| 4,437,518 | 3/1984 | Williams | 166/248 |
| 4,466,484 | 8/1984 | Kermabon | 166/60 |
| 4,471,838 | 9/1984 | Bodine | 166/249 |
| 4,558,023 | 12/1985 | Brun et al. | 502/108 |
| 5,282,508 | 2/1994 | Ellingsen et al. | 166/249 |
| 5,586,602 | 12/1996 | Vagin | 166/249 |

FOREIGN PATENT DOCUMENTS

| | | | |
|---|---|---|---|
| 1096298 | 3/1980 | Canada | 166/26 |
| 823072 | 4/1981 | Russian Federation . | |
| 1127642 | 6/1982 | Russian Federation . | |
| 1039581 | 9/1983 | Russian Federation . | |
| 1105582 | 7/1984 | U.S.S.R. | 166/177 |
| 1240112 | 5/1988 | U.S.S.R. | 166/249 |

OTHER PUBLICATIONS

Beresnev, Igor et al., "Elastic–wave stimulation of oil production: A review of methods and results," *Geophysics*, vol. 59, No. 6, Jun., 1994, pp. 1000–1017.

*Primary Examiner*—Hoang Dang
*Attorney, Agent, or Firm*—Banner & Witcoff Ltd.

[57] ABSTRACT

A method and apparatus are provided for improving the production of unswept and immovable oil from conventional oil wells. The oil recovery system utilizes an impulse wave device to produce impulse waves which travel down-hole and strike a bridge plug. When the impulse waves strike the bridge plug, weak elastic waves are created. After creation, the weak elastic waves propagate in all directions. The weak elastic waves are maintained in a general area near an oil formation by a conventional packer and a diffuser/deflector.

9 Claims, 5 Drawing Sheets

46
40
64
48
50
62
60
58
52
54
66
56
GROUND LEVEL
38
29
34
44
32
12
42
36
30
18
31
22
26
20
14
16

APPARATUS AND METHOD FOR INCREASING PRODUCTION RATES OF IMMOVABLE AND UNSWEPT OIL THROUGH THE USE OF WEAK ELASTIC WAVES

FEILD OF THE INVENTION

In general, the present invention pertains to techniques for increasing oil production in conventional oil wells, and more particularly to devices and methods which utilize weak elastic waves to increase the production rates of immovable and unswept oil not extracted during primary recovery. The invention also pertains to the use of elastic waves to increase recovery of other natural energy resources, such as natural gas.

BACKGROUND OF THE INVENTION

As used in this specification, the terms oil, natural oil, unrefined petroleum, and crude oil are used interchangeably and in general, refer to a thick, flammable, yellow-to-black mixture of gaseous, liquid, and solid hydrocarbons that occur naturally beneath the earth's surface. This naturally occurring substance can be separated into fractions including natural gas, gasoline, naphtha, kerosene, fuel and lubricating oils, paraffin wax and asphalt, and is used as a raw material for a wide variety of derivative products.

Unrefined petroleum is usually found in reservoirs retained in sandstones of different porosities throughout the world. These reservoirs are located anywhere from a few meters to several thousand meters beneath the earth's surface and the sea bottom. In addition, the reservoirs vary largely in size and complexity, with respect to their fluid and gas contents, pressures and temperatures.

Petroleum is extracted from these reservoirs by means of wells drilled into the sandstone formations. The well itself is a complicated construction, including casings which protect the well bore not only from the formation itself but also from the pressures exerted by the reservoir fluids.

Petroleum itself is drained from the productive formation by means of holes drilled in the casing. The petroleum is lifted to the surface through what is known as production tubing. This tubing is centralized inside the casing by means of special centralizers. These centralizers create an annulus between the production of tubing and casing.

Since the original reservoir pressure is initially higher than the complex forces of fluid adherence to porous media, it is relatively easy to produce petroleum at first. However, pressure decreases during the course of production, a point of equilibrium is reached at which the adhesion forces are higher than the complex forces of fluid adherence to the surrounding porous media. Unfortunately, at this point of equalization, a substantial portion of the petroleum is still located within the reservoir. After an oil well has been in operation for some time, its productivity often diminishes to the point at which the operation of the wells—from a commercial viewpoint—is either marginal or entirely unfeasible. Thus, substantial qualities of crude oil frequently remain in the ground in the regions of these unproductive wells but cannot be liberated by conventional techniques.

U.S. Pat. No. 5,282,508 ("the '508 patent") entitled "Process to Increase Petroleum Recovery from Petroleum Reservoirs," reported that as much as 85% of the petroleum contained within a well is initially not recovered through this normal production of oil through the point of equilibrium at which the oil reservoir is naturally depleted. Oil recovered through this point of equilibrium is generally referred to as the primary recovery. The index of primary recovery varies largely from one reservoir to another; however, the primary recovery index is typically 17 to 45 percent of the original oil in the reservoir.

Since a substantial portion of the oil remains in the reservoir after completion of the primary recovery, many devices and techniques have been developed in order to increase the production of oil beyond the primary recovery. One well-known technique involves the injection of water or gas into what is usually referred to as an injection well. This increases the pressure in the well and thereby "squeezes" additional oil from the well. Another technique is described in U.S. Pat. No. 4,049,053, entitled "Recovery of Hydrocarbons from Partially Exhausted Oil Wells by Mechanical Wave Heating." This conventional method of enhanced oil recovery involves the injection of high pressure water into the formation through adjacent wells. This added pressure serves to force the oil to the surface. The depths of the wells typically range from 1,500 to 15,000 feet or more. This method will generally extract approximately one-third of the deposit; however, the remaining two-thirds of the deposit are too viscous to flow at its ambient temperature, and therefore cannot be extracted. Furthermore, this technique is relatively expensive and is therefore not commercially feasible.

Other methods and devices have also been used to increase the recovery and production of crude oil. These include the use of sonic or supersonic waves in petroleum formations, stimulation of the area surrounding an oil well with electricity (electro-osmosis), heating a portion of the well area in order to reduce oil viscosity and thereby increase oil flow, the use of devices to create vibrations—either on the surface or in the well hole—to stimulate oil recovery, as well as other combinations of these and other techniques. Other methods that have been used without marked success include injection of solvents, electrical conduction heating, and heating by combustion of the formation.

Attention is invited to U.S. Pat. Nos.: 2,670,801; 2,799,641; 3,141,099; 3,169,577; 3,378,075; 3,507,330; 3,754,598; 3,874,450; 3,920,072; 3,952,800; 4,049,053; 4,060,128; 4,084,638; 4,345,650; 4,437,518; 4,466,484; 4,471,838; and 4,558,023; most of which are discussed in the '508 patent mentioned above. Attention is also invited to USSR Patent Document Nos. 823,072; 1,127,642; 1,039,581; and Canadian Patent No. 1,096,298. As of the time of filing of this Patent application, copies of all of these were available in the U.S. Patent Office, and have been provided to the patent examiner in connection with this application.

Despite the many efforts of others in this field, the challenge of increasing the production rates of immovable and unswept oil from partially exhausted oil wells still remain. Moreover, many of the prior art efforts rely on manufacture, use, and maintenance of complex and non-standard equipment to practice the enhanced oil recovery techniques. Additionally, many of the techniques described in prior art efforts of others were limited to increasing oil production in a small area, or a limited number of wells. To date, many enhanced oil recovery devices and methods are expensive to operate, and result in efficiency increases so limited as to restrict their large-scale commercial operation.

Disadvantages of some of the techniques of using elastic waves to achieve enhanced oil recovery include the generation of elastic waves at the surface of the oil well. In this arrangement much of the energy propagated is lost before it reaches the oil formation and, hence, is inefficient. Other techniques have attempted to generate elastic waves beneath the surface, down-hole in an oil well shaft. These techniques have created various types of waves down-hole, but have failed to capture the waves in an area of maximum benefit near the formation containing the oil sought to be released and recovered.

Another disadvantage of prior art systems, is that the systems allows air and other gases to remain within the system. Since air as well as other gases are very compressible media, the presence of air inside the down-hole tubing is extremely detrimental and prohibits the system from generating sufficient pressure within the tubing. For this reason, the valves that introduce air as well as water into such a system are disadvantageous.

It is an object of the present invention to provide a method for increasing the production rate of unswept and immovable oil through the use of commercially available tools and equipment.

It is another object of the present invention to provide a device that utilizes weak elastic waves in order to increase the recovery of unswept and immovable oil.

A further object of the invention is to provide a device capable of diffusing and deflecting weak elastic waves in order to maximize the recovery of immovable and unswept oil after completion of primary recovery.

Yet another object is to provide an apparatus which maintains a majority of weak elastic waves generated down-hole within a region near the formation of oil.

Another object of the invention is to provide a method and apparatus that can increase the production of oil in conventional wells within a sizeable surrounding radius, which, depending on the geologic formations in the oil fields, can conventionally range in a radius of 1–1½ miles from the site of the invention.

Still another object of the present invention is to provide a valve which does not introduce air or other gases into the system, and is capable of being utilized in conjunction with an impulse wave system.

SUMMARY OF THE INVENTION

The present invention relates to a method for increasing the production of oil from an oil well. This is accomplished by installing a bridge plug in an oil well casing generally near, but above, the oil formation. The casing is sealed and pressurized with water to ensure that it can withstand leakage under pressure. A diffuser-deflector is then attached to conventional tubing and lowered into the hole to a point generally about 50–75 meters above the bridge plug. The more specific location of the diffuser-deflector is calculated to accommodate the specific geologic formation, pressures to be utilized, and other factors as discussed below. While the location of the diffuser-deflector has an impact on the efficiency of the invention, the apparatus can be effectively used and method can be efficiently practiced with the diffuser-deflector in a variety of distances above the bridge plug.

Above the diffuser-deflector on tubing is a conventional packer, which is a device known to those of skill in this art and which conventionally is used to space tubing from the casing down-hole in an oil well. In the present invention, a conventional packer is used as a means for containing elastic waves within a region of maximum effectiveness for enhanced oil recovery.

An impulse wave device is installed in the tubing above the diffuser-deflector. As was true with respect to the diffuser-deflector, the specific location of the impulse wave device will vary yet still be within the scope of the invention. The impulse wave device generally, however, is located down-hole as described below. The system is filled with a liquid and closed. After all the air is removed, it is sealed to prevent leakage. The impulse wave device is activated to generate waves, which are transmitted through the down-hole tubing past the diffuser-deflector. The waves are then contained within the area of the casing between the bridge plug and the packer, resonating and deflecting energy into the oil formation adjacent the casing. It has been found with this method that oil wells considerably distant from the site of the invention can also be favorably affected, resulting in enhanced oil recovery from numerous receptor oil wells.

This invention also relates to devices for carrying out the method described above. One such device is the diffuser-deflector, which is designed to direct waves initially generated by the impulse wave device in a pattern to spread the energy across the walls of the casing and the bridge plug. The diffuser-deflector also contains a deflector, which substantially prevents weak elastic waves from traversing back up the tubing toward the impulse wave device.

Another device for carrying out the method is a water make-up valve, which is specially designed to withstand the rugged use and pressures necessarily present in such a system.

These as well as other novel advantages, details, embodiments, features and objects of the present invention will be apparent to those skilled in the art from the following detailed description of the invention, the attached claims and accompanying drawings, listed hereinbelow, which are useful in explaining the invention.

BRIEF DESCRIPTION OF DRAWINGS

In the text which follows and in the drawings, wherein similar reference numerals denote similar elements throughout the several views thereof, the present invention is explained with reference to illustrative embodiments, in which.

DETAILED DESCRIPTION OF THE INVENTION

Figure 1:
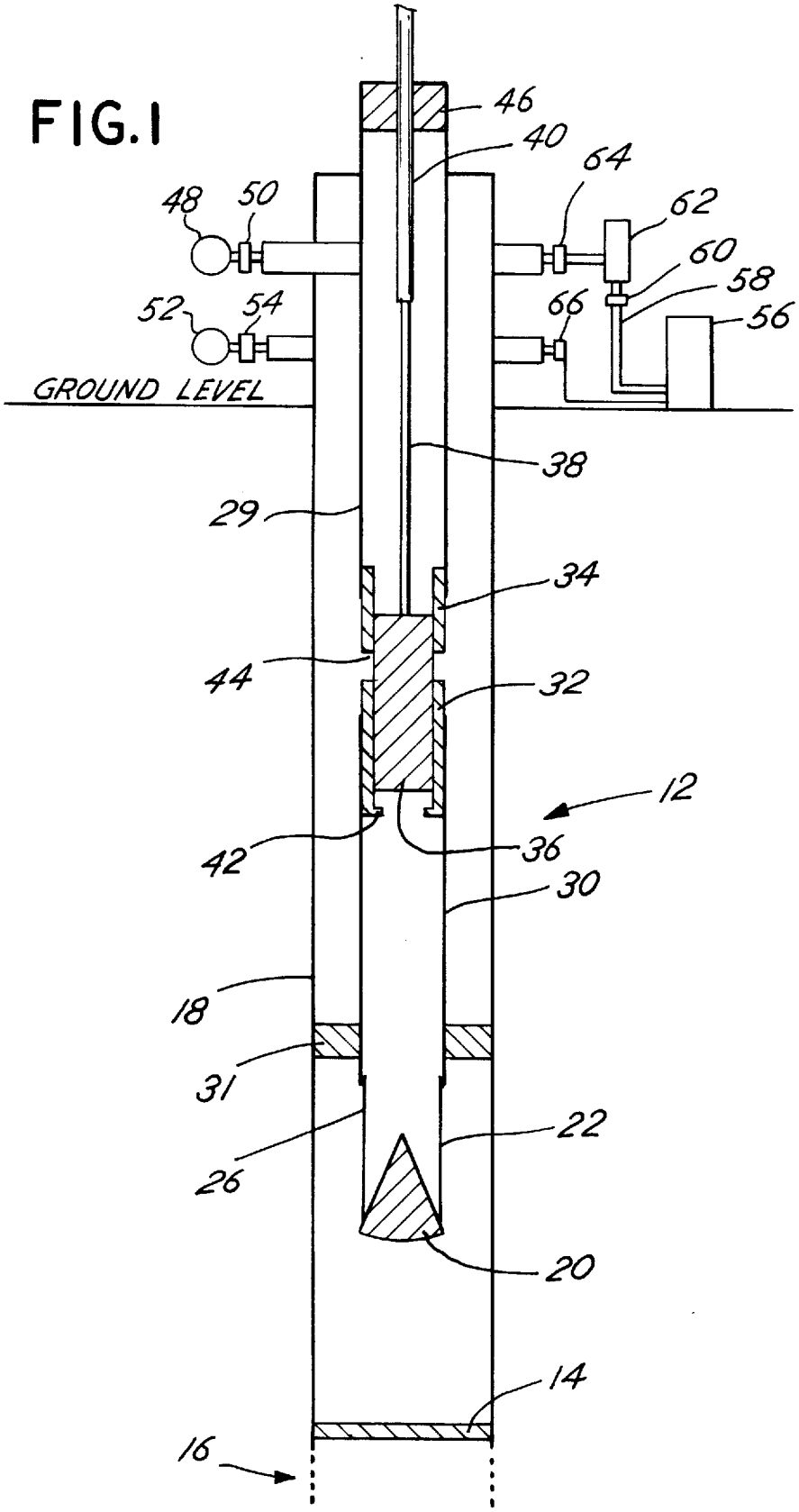
FIG. 1 is a side elevation, partially broken away, of a device—constructed in accordance with the present invention—utilized in an oil well or in a cylindrical hole in the ground, that increases the production rate of immovable and unswept oil in surrounding, partially exhausted oil wells located within a reasonable distance from the device.
Figure 2:
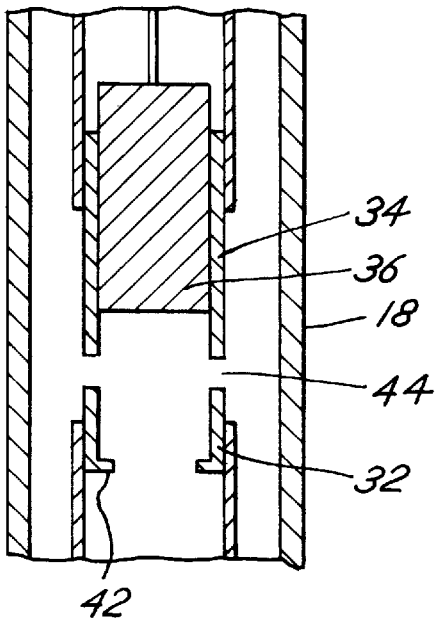
FIG. 2 shows an enlarged side elevation, partially broken away, of the compression cylinder and impulse wave device of the present invention, and illustrates the initial vertical position of the compression cylinder within the impulse wave device.
Figure 3:
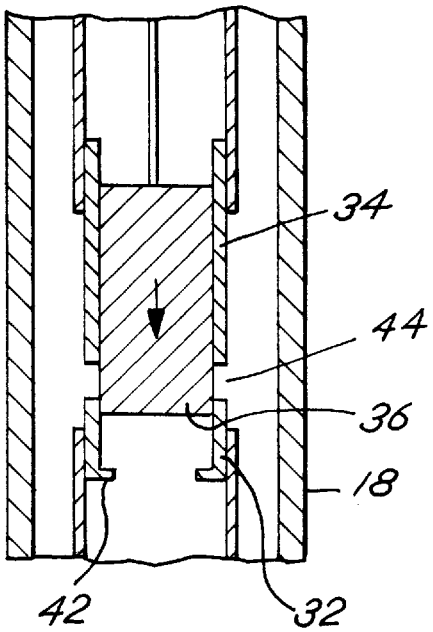
FIG. 3 illustrates the intermediate vertical position of the compression cylinder within the impulse wave device.
Figure 4:
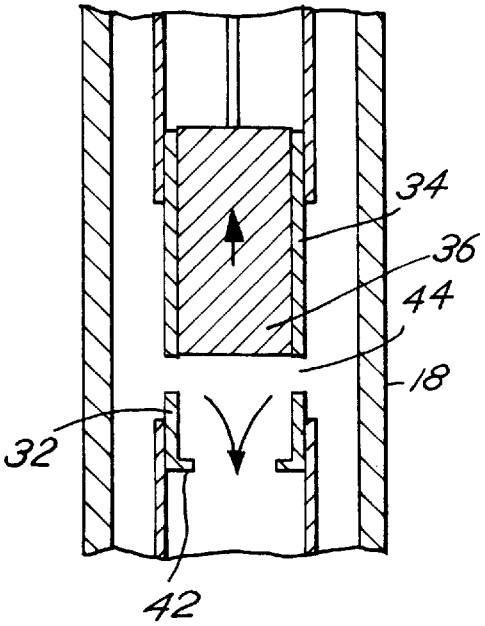
FIG. 4 depicts the final vertical position of the compression cylinder within the impulse wave device.
Figure 5:
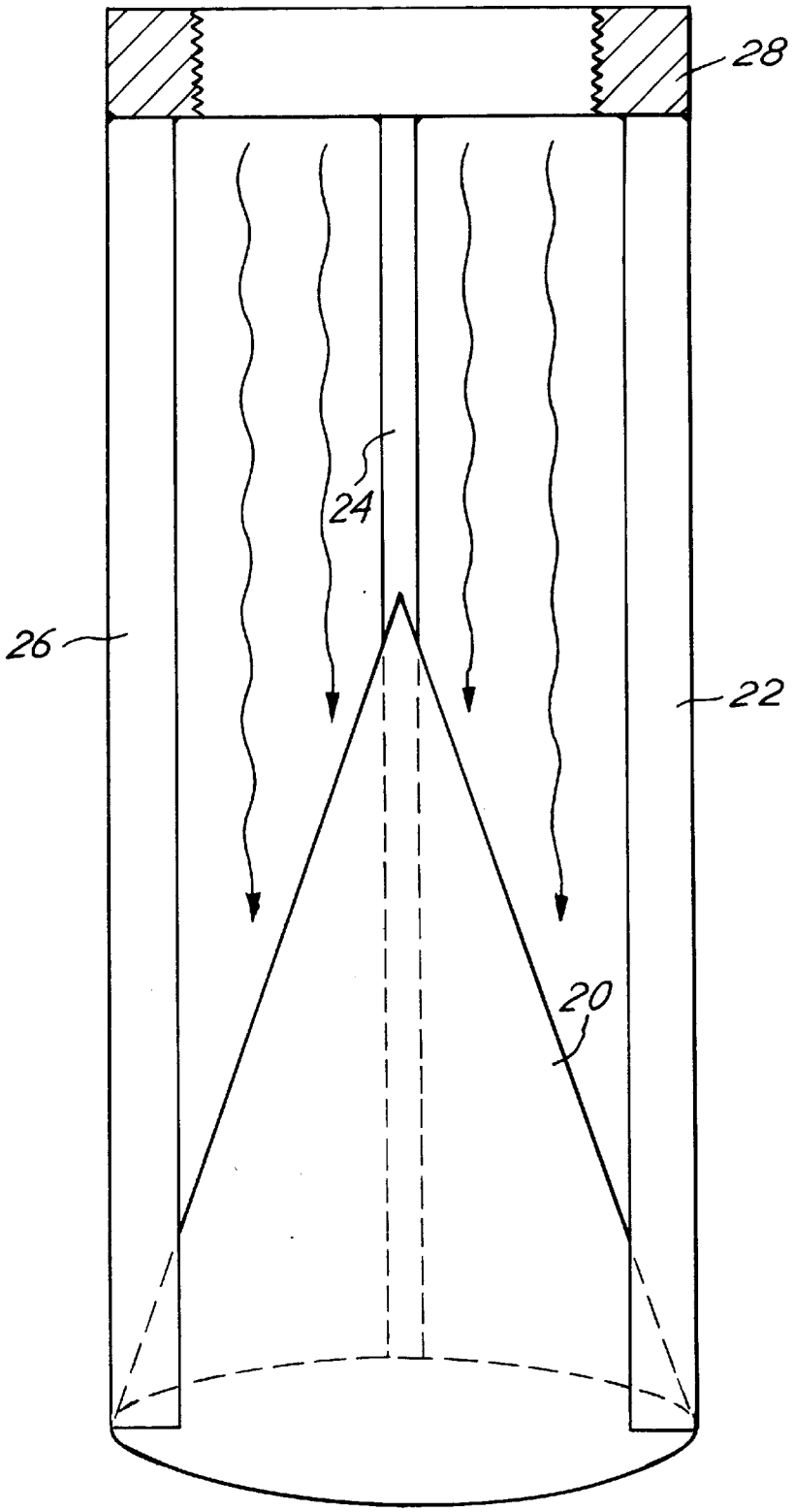
FIG. 5 shows the suspended diffuser-deflector, and generally illustrates the direction of weak elastic wave propagation after creation.
Figure 6:
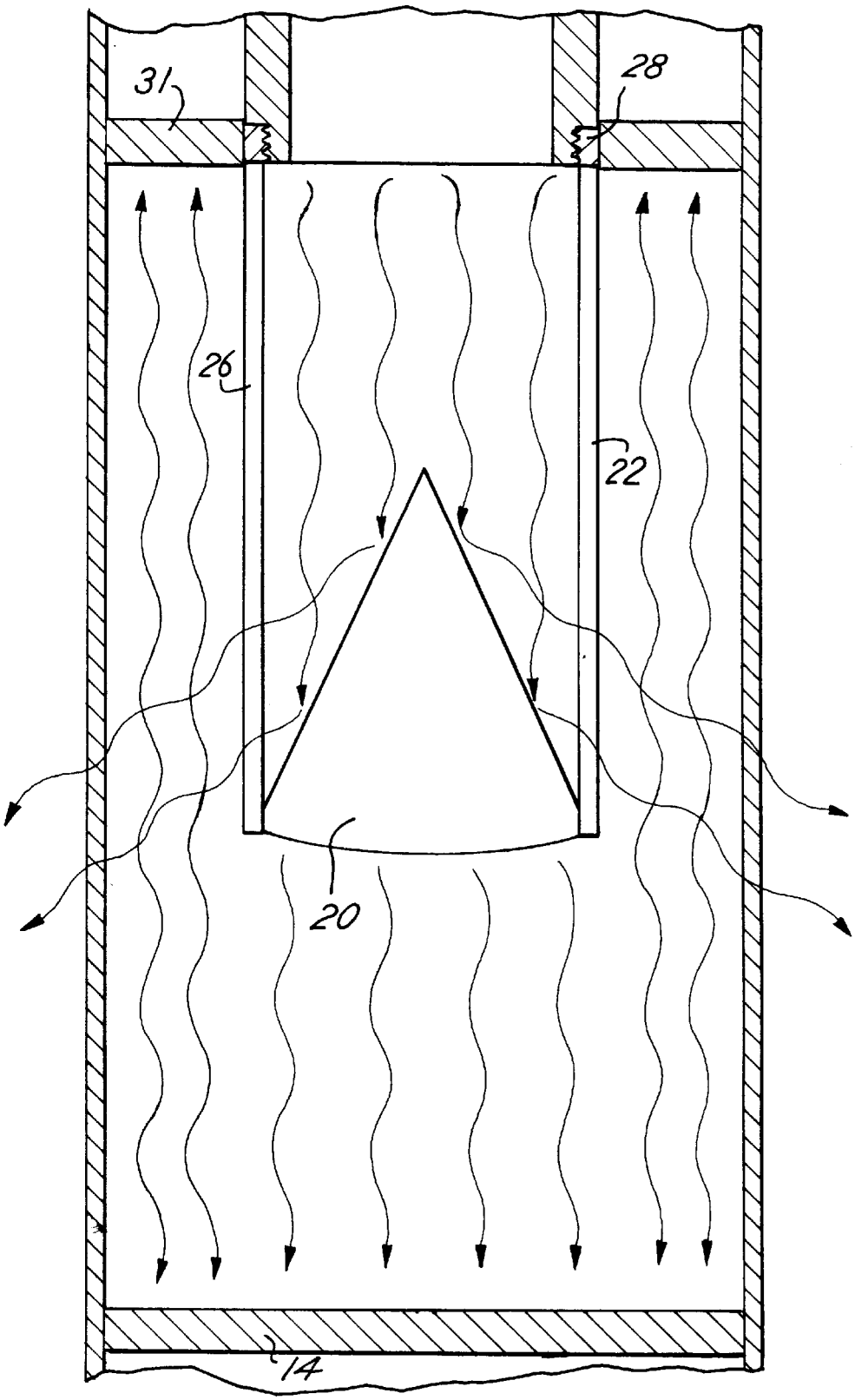
FIG. 6 is an enlarged view of the suspended diffuser-deflector, and generally illustrates the direction of weak elastic wave propagation and deflection after creation.

For a better understanding of the present invention, reference may be had to the following detailed description taken in conjunction with the appended claims and accompanying drawings. In essence, the present invention is based on the concept of increasing the production rate of oil from existing, partially depleted, receptor oil wells located in a particular region or oil field, by stimulating various underground areas with weak elastic waves.

In a preferred embodiment of the present invention, an oil well 12—or other cylindrical hole in the ground—is converted into an energy source which increases oil production in surrounding receptor oil wells. If an existing oil well is used, all equipment and materials must initially be removed from the well, including the rod string, sucker rods, tubing, drill, down-hole pump, etc. Next a bridge plug 14 is installed in the oil well 12 above the perforations 16—through which oil previously entered the bottom of the well 12 before the well had become partially depleted. The bridge plug 14 is a metal plug that operators install by lowering the plug 14 into the bottom of a well 12. The plug 14 is then set off with an explosive charge that expands the plug 14 and locks the plug 14 against the casing wall 18—which abuts the oil well wall itself. Thus, the bridge plug 14 provides a 100% seal between the portions of the oil well 12 located above and below the bridge plug 14.

After the bridge plug 14 has been installed, the casing 18 is then filled with water. After the casing 18 has been filled with water, the casing 18 is then hydro-tested under 1000 lbs. of pressure per square inch for thirty minutes to ensure that the casing 18 will hold pressure without leaking. If the casing 18 leaks pressure, it cannot be used and must be replaced. If the casing 18 successfully passes its hydro-test, then a diffuser-deflector 20 is welded to three, metal support structures 22, 24, 26 which are equally positioned at 120 degree intervals around the diffuser-deflector 20. The support structures 22, 24, 26 are then welded to a threaded fitting 28, which threadingly engages a length of down-hole tubing 30. In the preferred embodiment, the diffuser-deflector 20 is made out of metal and is shaped in a substantially conical configuration with the bottom portion thereof slightly curved. Subsequent sections of tubing, including down-hole tubing 30 as well as high pressure tubing 29, are fastened to the first section of tubing 30 as well as to each other and are lowered down-hole, until the diffuser-deflector 20 is positioned approximately fifty to seventy meters above the bridge plug 14. After installation of tubings 29 and 30, at least one conventional packer 31 is installed in between the casing wall 18 and the down-hole tubing 30. As described above, the packer 31 supports the down-hole tubing 30 and, as described in more detail below, also blocks elastic wave deflections.

A compression barrel 32 and a compression cylinder guide 34, collectively impulse wave device, are also coupled to the inner surface of both the down-hole tubing 30 and the high pressure tubing 29. The compression barrel 32 and the compression cylinder guide 34 can be positioned at various heights above the diffuser-deflector 20 depending on the amount of wave pressure desired. In the preferred embodiment, the following formula is used to determine how far beneath ground level the impulse wave device is located within the down-hole tubing 30:

$$D=((P_{dia})^2\times(PS))/((20000)^{-1}\times((T_{dia})^2-(RS_{dia})^2)\times A)$$

In the foregoing formula all units are in centimeters and the following symbols designate their corresponding variables: "D" denotes the distance from the ground to the top of the impulse wave device, "$P_{dia}$" denotes the diameter of the compression cylinder 36, "PS" denotes the length of the compression stroke, "$T_{dia}$" denotes the diameter of the high pressure tubing 29, "$RS_{dia}$" denotes the diameter of the rod string 38, and "A" denotes the atmospheres of pressure that are developed. It should be noted that all high pressure tubing 29 located above the impulse wave device should be capable of withstanding at least 8000 pounds of pressure per square inch. It should also be noted that, in the preferred embodiment, the length of the compression barrel 32 is approximately two feet longer than the length of the compression stroke.

After the foregoing elements have been assembled and positioned, a substantially cylindrical compression cylinder 36 is coupled to a rod string 38. Next, the compression cylinder 36 and the rod string 38 are lowered into the high pressure tubing 29. The compression cylinder 36 is lowered through the compression cylinder guide 34 and all the way into the compression barrel 32 until the compression cylinder 36 contacts the seating nipple 42 which, in essence, prevents the compression cylinder 36 from falling to the bottom of the well if the rod string 38 ever breaks.

After the compression cylinder 36 is properly situated on the seating nipple 42, the high pressure tubing 29 is filled with water. Then, the rod string 38 is slowly pulled back up until the compression cylinder 36 enters the release nipple area 44. The release nipple 44 comprises a region of space of approximately twelve inches in length between the compression cylinder guide 34 and the compression barrel 32. Next, the rod string 38 is pulled up another two inches and this position is marked—this position designates the top of the compression stroke. After the top of the compression stroke has been determined, a hardened polish rod 40 is coupled to the rod string 38, and a pump jack (not shown) is secured to the hardened polish rod 40.

The remaining conventional oil well components can then be assembled. These components include, but are not limited to, a stuffing box 46 which maintains pressure within the high pressure tubing 29 and through which the hardened polish rod 40 passes; a high pressure tubing pressure gauge 48 and its corresponding high pressure valve 50 which allow the pressure inside the high pressure tubing 29 to be monitored; a casing pressure gauge 52 and its corresponding high pressure valve 54 which allow the pressure inside the casing 18 to be monitored; a fifty-five gallon water drum 56; a ¾" copper feeder pipe 58; a ¾" union 60; a make-up water feeder 62; a water make-up valve 64; and a relief valve 66.

Next, the pump jack is turned on and therefore starts to actuate the hardened polish rod 40, the rod string 38, and the compression cylinder 36. During the first few strokes of the pump jack, the union 60 is generally loosened and the water make-up valve 64 is turned into an inverted position. Thus, the first few strokes of the pump jack force all of the air out of the system. This is very important. Since air is a very compressible medium, the presence of air inside the high pressure tubing 29 is extremely detrimental and prohibits the system from generating sufficient pressure within the high pressure tubing 29. After water starts to be forced out of the water make-up valve 64, the union 60 can be tightened and the water make-up valve 64 can be properly oriented.

At this point, the system is ready for operation. During operation, the pump jack continues to actuate the polished rod 40, the rod string 38, and the compression cylinder 36. As the compression cylinder 36 is raised within the compression barrel 32, the water above the high pressure tubing 29 is compressed. As soon as the compression cylinder 36 is raised into the release nipple area 44, the water pressure above the high pressure tubing 29 is partially released, thereby creating an impulse wave which rapidly travels down the down-hole tubing 30. As the wave impacts the diffuser-deflector 20, the wave is partially deflected in an outward direction and at least a portion of the impulse wave continues down-hole, thereby impacting the bridge plug 14. As the wave deflects off of the bridge plug 14 as well as other surfaces, weak elastic waves, which this action creates, are then maintained in this lower area of the well by the packer 31 and the diffuser-deflector 20. The packer prevents the weak elastic waves from traveling back up the well bore in the region of space formed between the casing wall 18 and the down-hole tubing 26. The diffuser-deflector 20 prevents the weak elastic waves from traveling back up the down-hole tubing 30. Thus, the weak elastic waves are maintained and are focused in this formation region, thereby stimulating the recovery of natural resources, including but not limited to oil, in areas surrounding the well. Natural resource recovery has been increased in receptor wells located over two miles away from the present invention.

Figure 7:
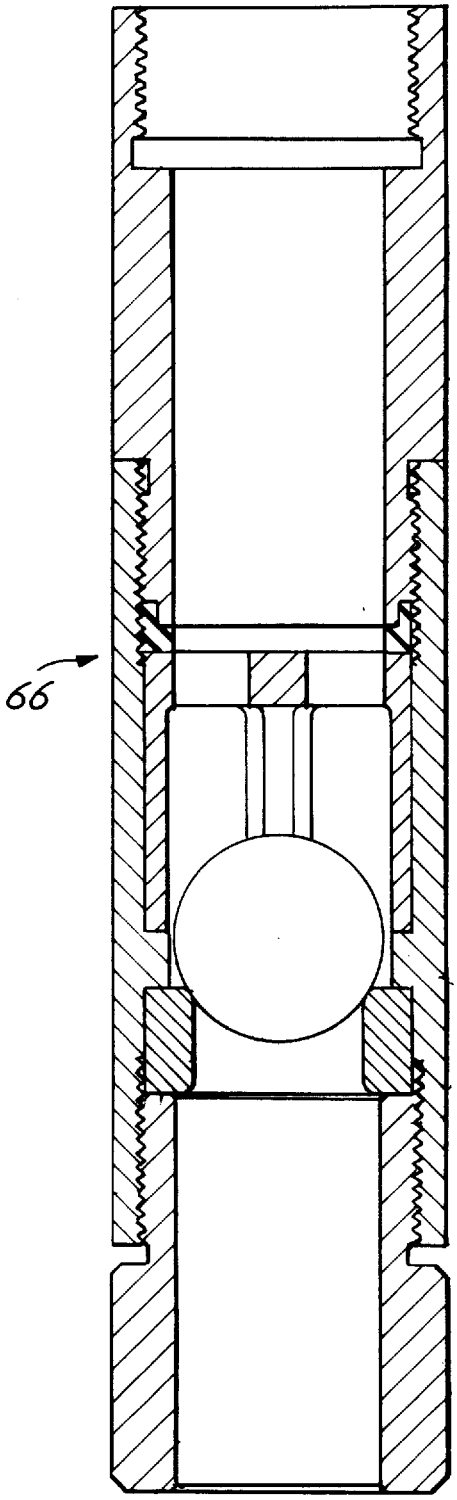
FIG. 7 is a side elevation, partially broken away, of a conventional ball-and-seat, water make-up valve commonly used in prior art enhanced oil recovery systems.
Figure 8:
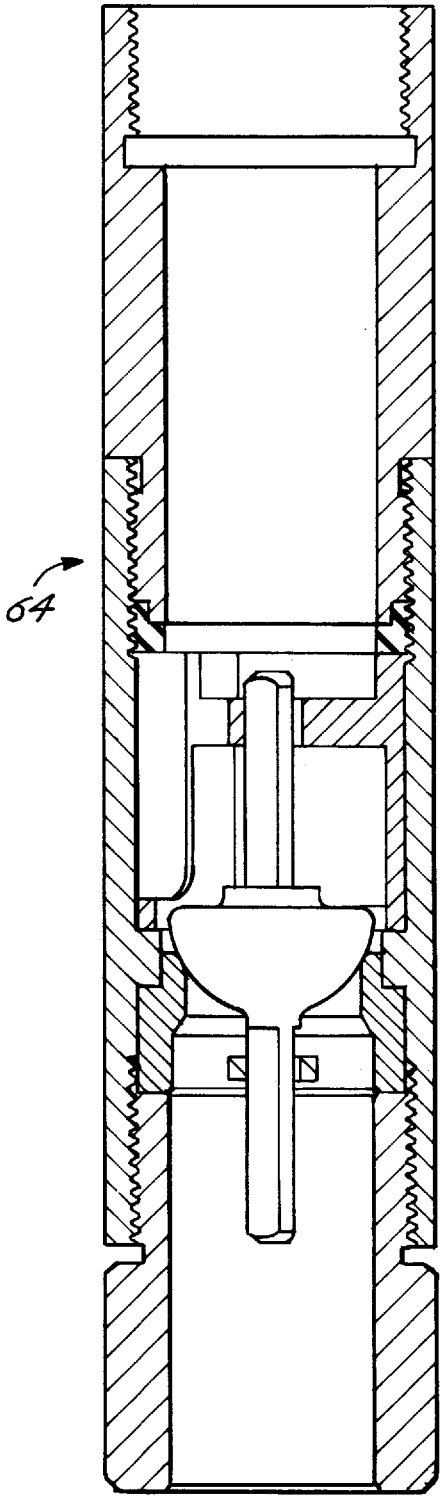
FIG. 8 is a side elevation, partially broken away, of the improved, water make-up valve seating design constructed in accordance with various aspects of the present invention.

During operation, an increase in pressure is observed in the high pressure tubing 29 when the compression cylinder 36 is raised into the release nipple area 44. In order to evacuate air from the system when this release in pressure occurs, water is drawn into the high pressure tubing 29 during this brief instant of decreased pressure. The water supplied to the high pressure tubing 29 is provided through the valve 64 which draws water from the water drum 56 through the pipe 58 and through the union 60. In the preferred embodiment, a plunger-and-stem type valve is utilized as the water make-up valve 64, such as the Petrovalve as sold by U.S.A. Petrovalve Inc. depicted in FIG. 8. Continuous testing has proven that this type of valve is substantially more durable than a conventional ball-and-seat valve, such as is depicted in FIG. 7. As the pressure within the casing 18 exceeds a maximum threshold, the excess pressure is purged through the pressure relief valve 66 which returns the excess water to the water drum 56 for reuse.

It should also be noted that in alternative embodiments where a stuffing box 46 is not desired, a nitrogen boosted hydraulic system (not shown) can be utilized in place of the conventional pump jack. In this embodiment, nitrogen gas pushes down on a piston and counter balances the weight of the rod string 38. Pressurized fluid from a pump is routed to a control valve and cycles the cylinder rod up and down. If this embodiment is utilized, the inventor recommends using the nitrogen boosted hydraulic system manufactured by Tieben, Inc.

SCOPE

In the foregoing specification, the present invention has been described with reference to specific exemplary embodiments thereof. It will be apparent to those skilled in the art, that a person understanding this invention may conceive of changes or other embodiments or variations, which utilize the principles of this invention without departing from the broader spirit and scope of the invention as set forth in the appended claims. All are considered within the sphere, spirit, and scope of the invention. The specification and drawings are, therefore, to be regarded in an illustrative rather than restrictive sense. Accordingly, it is not intended that the invention be limited except as may be necessary in view of the appended claims.

What is claimed is:

1. A method for increasing oil production in an oil field comprising the steps of:

(a) generating an impulse wave within a well that has down-hole tubing, said impulse wave traveling through at least a portion of said down-hole tubing;

(b) at least partially deflecting said impulse wave with a deflector and thus causing at least one elastic wave to be formed and propagated into an area surrounding the well;

(c) allowing at least a portion of said at least one elastic wave to travel down-hole past said deflector; and (d) preventing at least a percentage of said portion of said at least one elastic wave from deflecting back up-hole into the down-hole tubing, whereby oil production in the oil field is increased.

2. A system for increasing oil production in an oil field, the system comprising:

(a) a casing disposed about the inner surface of a well;

(b) a tubing member coaxially disposed within the casing said casing and said tubing member defining a region of space therebetween;

(c) means for generating an impulse wave coupled to said tubing member; and (d) means for diffusing and deflecting said impulse wave into at least one elastic wave, said means for diffusing and deflecting coaxially disposed beneath and suspended from said tubing member, said means for diffusing and deflecting allowing at least a portion of said at least one elastic wave to travel down-hole past said means for diffusing and deflecting, said means for diffusing and deflecting substantially preventing at least a percentage of said portion of said at least one elastic wave from traveling up the tubing member after having been deflected and traveled down-hole past said means for diffusing and deflecting.

3. The system for increasing oil production of claim 2 further comprising blocking means coupled to the casing and the tubing member, said blocking means preventing said at least one elastic wave from traveling up the well in the region of space between the casing and the tubing member after having been deflected, said blocking means maintaining said at least one elastic wave within an area of the well in order to improve oil production in the oil field.

4. The system for increasing oil production of claim 2 wherein said means for diffusing and deflecting comprises a substantially conical member.

5. The system for increasing oil production of claim 3 wherein the blocking means comprises at least one packer.

6. The system for increasing oil production of claim 3 wherein the well is at least partially filled with water and wherein said means for generating comprises: a compression barrel coupled to the tubing member and a compression cylinder coaxially disposed within the compression barrel, said compression cylinder capable of being raised in order to compress a portion of the water located above the compression cylinder, whereby said impulse wave is generated and travels down the tubing member when the compression cylinder is raised above the compression barrel.

7. The system for increasing oil production of claim 3 wherein a plurality of perforations are disposed in a portion of the casing located beneath said means for diffusing and deflecting.

8. The system for increasing oil production of claim 7 wherein a curvilinear bridge plug is secured across the entire diameter of the casing, said curvilinear bridge plug positioned above the perforations and beneath said means for diffusing and deflecting.

9. A system for increasing oil production in an oil field, the system comprising:

(a) a casing disposed about the inner surface of a well;

(b) a tubing member coaxially disposed within the casing, said casing and said tubing member defining a region of space therebetween;

(c) means for generating an impulse wave coupled to said tubing member;

(d) means for diffusing and deflecting said impulse wave into at least one elastic wave, said means for diffusing and deflecting coaxially disposed beneath and suspended from said tubing member, said means for diffusing and deflecting substantially preventing said at least one elastic wave from traveling up the tubing member after having been deflected; and (e) a valve through which water is drawn into the tubing member, said valve having an outer housing with an axial bore formed therein, a plunger with at least one stem axially projecting therefrom, the plunger and the stem positioned within said axial bore.

* * * * *